US008500608B1

(12) United States Patent
Bonomi

(10) Patent No.: US 8,500,608 B1
(45) Date of Patent: Aug. 6, 2013

(54) EXERCISE APPARATUS COMPRISING A SLIDABLE WEIGHT BAR ASSEMBLY WITH HAND BRAKE ASSEMBLIES

(71) Applicant: Rhiannon Corp., Belize (BZ)

(72) Inventor: Roberto Bonomi, Rieti (IT)

(73) Assignee: Rhiannon Corp., Belize (BZ)

( * ) Notice: Subject to any disclaimer, the term of this patent is extended or adjusted under 35 U.S.C. 154(b) by 0 days.

(21) Appl. No.: 13/755,729

(22) Filed: Jan. 31, 2013

Related U.S. Application Data

(63) Continuation of application No. 13/668,820, filed on Nov. 5, 2012.

(51) Int. Cl.
*A63B 21/062* (2006.01)

(52) U.S. Cl.
USPC ..... 482/101; 482/98

(58) Field of Classification Search
USPC ..... 482/79, 92–105, 131–132, 139
See application file for complete search history.

(56) References Cited

U.S. PATENT DOCUMENTS

| | | | | |
|---|---|---|---|---|
| 3,752,473 | A | 8/1973 | LaLanne | |
| 3,866,914 | A * | 2/1975 | Jackson | 473/438 |
| 4,286,782 | A | 9/1981 | Fuhrhop | |
| 4,836,535 | A | 6/1989 | Pearson | |
| 4,872,670 | A | 10/1989 | Nichols | |
| 5,050,868 | A | 9/1991 | Pearson | |
| 5,669,859 | A | 9/1997 | Liggett et al. | |
| 6,231,486 | B1 | 5/2001 | Lee | |
| 6,623,409 | B1 | 9/2003 | Abelbeck | |
| 7,115,080 | B2 | 10/2006 | Cockrill, Jr. et al. | |
| 7,909,743 | B1 | 3/2011 | Webber | |
| 2002/0193214 | A1 * | 12/2002 | Ish, III | 482/92 |
| 2004/0097353 | A1 | 5/2004 | Mencis et al. | |
| 2006/0194678 | A1 * | 8/2006 | Turner | 482/94 |
| 2006/0252609 | A1 | 11/2006 | Abelbeck | |
| 2006/0252612 | A1 | 11/2006 | Melcer | |
| 2006/0252615 | A1 | 11/2006 | Melcer | |

OTHER PUBLICATIONS

"Free Motion Fitness Squat Machine," https://www.medco-athletics.com/Supply/Product.asp?Leaf Id=551874, dated Medco Sports Medicine Copyright 2012 Patterson Medial Holdings, Inc. (retrieved on Nov. 2, 2012) (3 pages).

"FreeMotion Squat," http://www.freemotionfitness.com/webapp/wcs/stores/servlet/Product (retrieved Nov. 2, 2012) (4 pages).

"Gym Smarts: Free Motion (Squats)—Watch WedMD Video," http://www.webmd.com/fitness-exercise/video/gym-smarts-free-motion-squats (retrieved Nov. 2, 2012) (2 pages).

* cited by examiner

*Primary Examiner* — Oren Ginsberg
(74) *Attorney, Agent, or Firm* — Proskauer Rose LLP

(57) ABSTRACT

Exercise apparatus having a slidable weight bar assembly with hand brake assemblies is provided for enaging and disengaging the weight bar assembly with a support frame. The exercise apparatus can be configured as a squat machine or a bench press. The exercise apparatus can include an adjustable back support that facilitates proper positioning and support of the operator's upper and lower back while performing squat exercises. The exercise apparatus can further include spring assemblies that increase the kinetic load during downward movements of the slidable weight bar assembly.

10 Claims, 5 Drawing Sheets

EXERCISE APPARATUS COMPRISING A SLIDABLE WEIGHT BAR ASSEMBLY WITH HAND BRAKE ASSEMBLIES

RELATED APPLICATIONS

This application is a continuation of U.S. application Ser. No. 13/668,820, filed on Nov. 5, 2012, entitled "Exercise Apparatus Comprising A Slidable Weight Bar Assembly With Hand Brake Assemblies" by Roberto Bonomi, the entirety of which is hereby incorporated by reference.

FIELD OF THE INVENTION

The invention generally relates to exercise apparatus and, in particular, the structure and use of exercise apparatus comprising a slidable weight bar assembly with hand brake assemblies.

BACKGROUND

There are many different types of fitness equipment that can be used to develop a person's strength, stamina and physique. One type of fitness equipment is the free weight squat machine that can be used to strengthen one's leg muscles by performing squat exercises. Free-weight squat machines can also be reconfigured to perform other exercises, such as bench press. Known free weight squat machines typically employ a horizontal weight bar on which free weights can be added or removed. The weight bar is typically coupled to a support frame that enables guided movement of the bar during the exercise. A difficulty with such fitness equipment is that the techniques used for locking the weight bar to the support frame before and after the exercise is cumbersome, leading to injuries if not performed properly. Furthermore, by virtue of the locking techniques employed with known free weight squat machines, the variety of squat exercises that can be performed is limited.

SUMMARY

Embodiments of the invention include an exercise apparatus comprising a slidable weight bar assembly with hand brake assemblies. In more detail, the apparatus comprises a support frame that includes vertical sliding poles and plural sets of latch catches. The slidable weight bar assembly, which is capable of guided movement along the slide poles, comprises hollow sliding guides coupling the slidable weight bar assembly to the vertical slide poles; horizontal weight bars extending horizontally from the hollow sliding guides; a set of latch assemblies coupled to an exterior of the sliding guides, the set of latch assemblies capable of pivotal movement for engagement with the plural sets of latch caches of the support frame; arm handles extending from the weight bar assembly to form a yoke about a neck and shoulder area; and a pair of hand brake assemblies, each hand brake assembly coupled to a terminal end of a respective arm handle, each hand brake assembly further coupled to a respective latch assembly of the set of latch assemblies by a transmission cable. The hand brake assemblies are operable to pivot the set of latch assemblies into a first position for disengaging the slidable weight bar assembly from one of the plural sets of latch catches of the support frame and into a second position for engaging the slidable weight bar assembly into one of the plural sets of latch catches of the support frame. The exercise apparatus can be configured as a squat machine or as a bench press.

In particular embodiments, each of the hand brake assemblies comprises a lever. When the levers are in a depressed state, the respective transmission cables each transmits a first mechanical signal causing the set of latch assemblies to pivot into the first position for disengaging the slidable weight bar assembly from one of the plural sets of latch catches. As a result, guided movement of the slidable weight bar assembly along the slide poles is enabled. Conversely, when the levers are in a released state, the respective transmission cables each transmits a second mechanical signal causing the set of latch assemblies to pivot into the second position for engaging the sliding weight bar assembly into one of the plural sets of latch catches. As a result, guided movement of the sliding weight bar assembly is prevented. In one particular embodiment, the guided movement of the sliding weight bar assembly is prevented in a downward direction only. Each latch assembly can further comprise a spring that compresses or decompresses to pivot a latch member when receiving the first mechanical signal or the second mechanical signal, respectively, from the transmission cable.

In other particular embodiments, the weight bar assembly can further comprise a back support adjustably coupled to the slidable weight bar assembly.

In still other particular embodiments, the exercise apparatus can further comprise springs, each spring positioned about one of the vertical sliding poles at a height above the slidable weight bar assembly. During an upward movement of the weight bar assembly, the springs are compressed by the hollow sliding guides. During a downward movement of the weight bar assembly, the springs are released and generate an additional downward force on the weight bar assembly.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
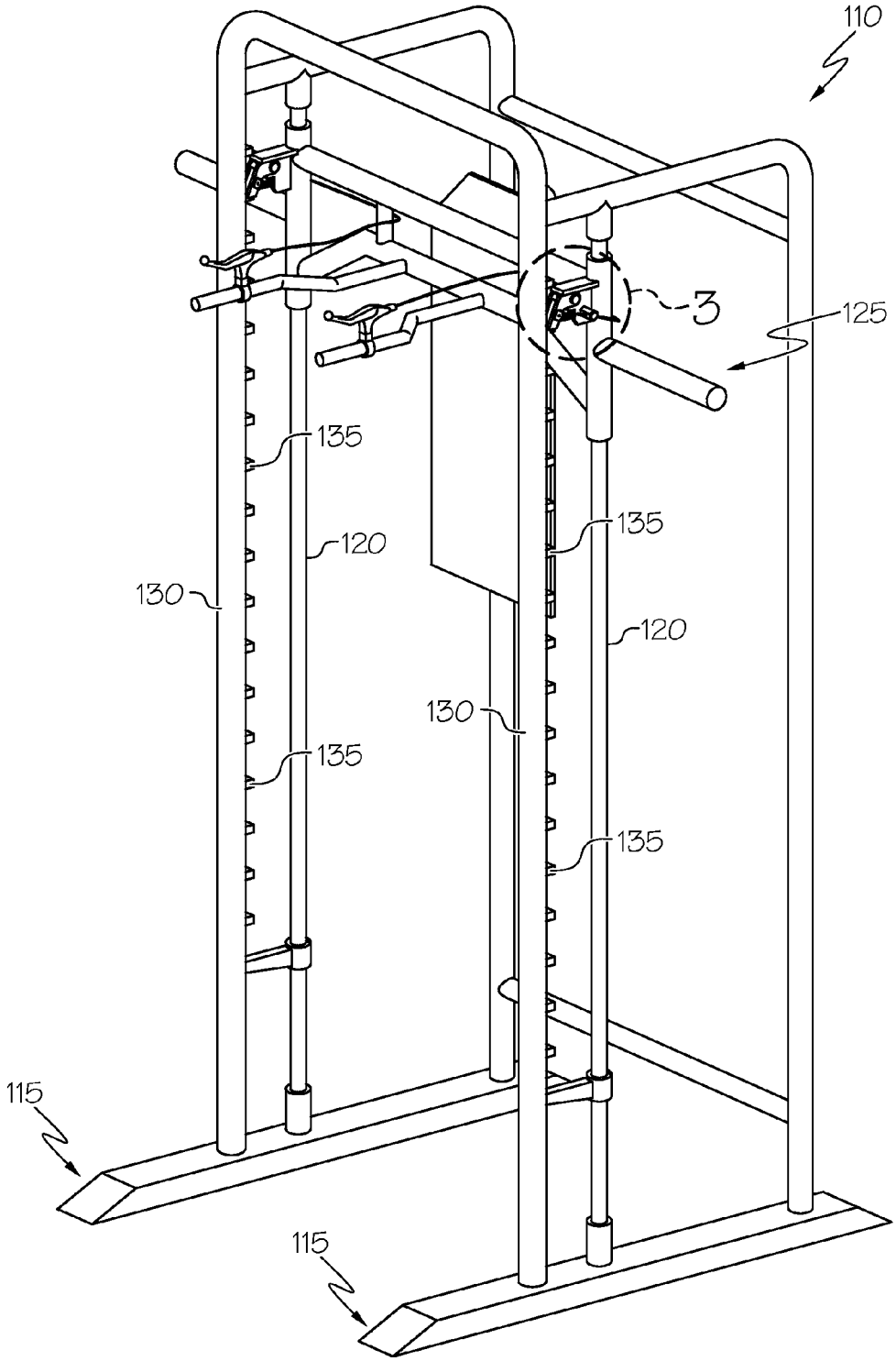
FIG. 1 is a diagram illustrating an exercise apparatus comprising a slidable weight bar assembly with hand brake assemblies according to one embodiment.

FIG. 1 is a diagram illustrating an exercise apparatus comprising a slidable weight bar assembly with hand brake assemblies according to one embodiment.

As shown in FIG. 1, the exercise apparatus includes a support frame 110 having a base 115. Extending perpendicular from the base is a pair of vertical slide poles 120. The slidable weight bar assembly 125 is moveably coupled to the vertical slide poles of the support frame. The support frame 110 also includes a pair of vertical frame members 130 extending perpendicular from the base 115 in parallel with the slide poles 120. Each frame member having protruding portions 135 extending from an exterior of the frame member towards an opposing slide pole. The protruding portions 135 are preferably vertically spaced equal distances apart along each frame member. As discussed in more detail below, horizontal pairs of protruding portions 135 of the frame members function as catches for a pair of latches arranged on the slidable weight bar assembly.

Figure 2:
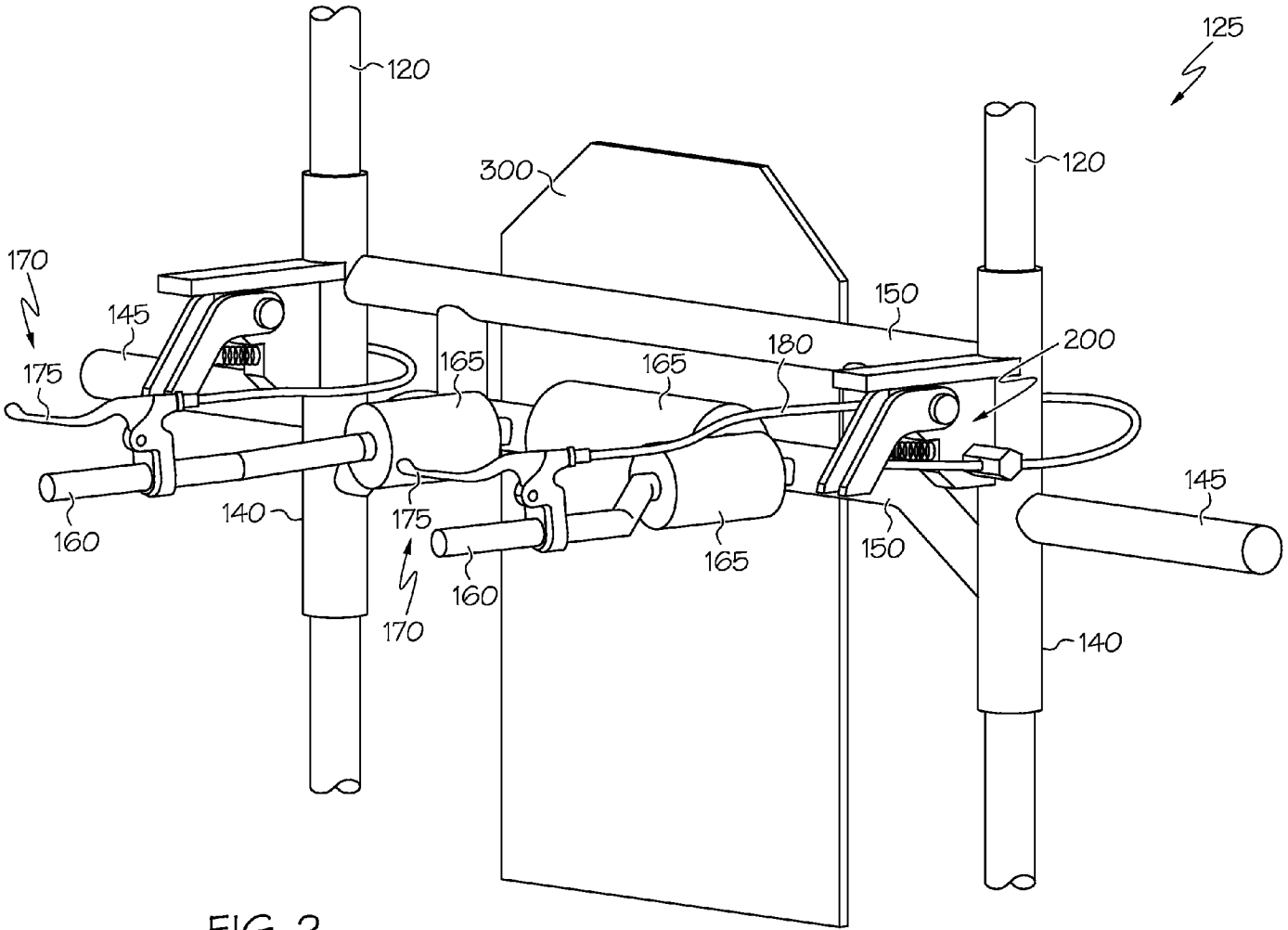
FIG. 2 is a diagram illustrating a front view of the slidable weight bar assembly according to one embodiment.

FIG. 2 is a diagram illustrating a front view of the slidable weight bar assembly according to one embodiment.

As shown in FIG. 2, the slidable weight bar assembly includes a planar arrangement of a pair of vertical sliding guides 140, horizontal weight bars 145 and one or more coupling bars 150. Specifically, the pair of hollow sliding guides 140 moveably couple the slideable weight bar assembly to the pair of vertical slide poles 120 of the support frame 110. The coupling of the hollow sliding guides to the slide poles facilitates guided movement of the slidable weight bar assembly in upward and downward directions. Extending from each of the hollow sliding guides is a horizontal weight bar 145 on which free weight (not shown) can be added or removed.

The hollow sliding guides 140 are fixedly connected to each other by one or more coupling bars 150. The one or more coupling bars 150 can be horizontally arranged between the pair of sliding guides. The one or more coupling bars 150 can also be arranged in other configurations, including the planar arrangement shown in FIG. 2.

Extending outwardly from the planar arrangement of the slidable weight bar assembly is a pair of arm handles 160. As shown in FIG. 2, the arm handles can extend from at least one of the coupling bars 150. The arm handles 160 can have a configuration that forms a yoke about a person's neck and shoulder area. Portions of the arm handles 160 and coupling bar 150 can be covered with padding 165 to protect such areas. Furthermore, a pair of hand brake assemblies 170 is coupled to the terminal ends of the respective arm handles 160. Each hand brake assembly can have a lever 175 that is indirectly coupled to a latch assembly 200 by a transmission cable 180. As shown in FIG. 2, the hand brake assembly 170 can be of a type used with bicycles.

Figure 3:
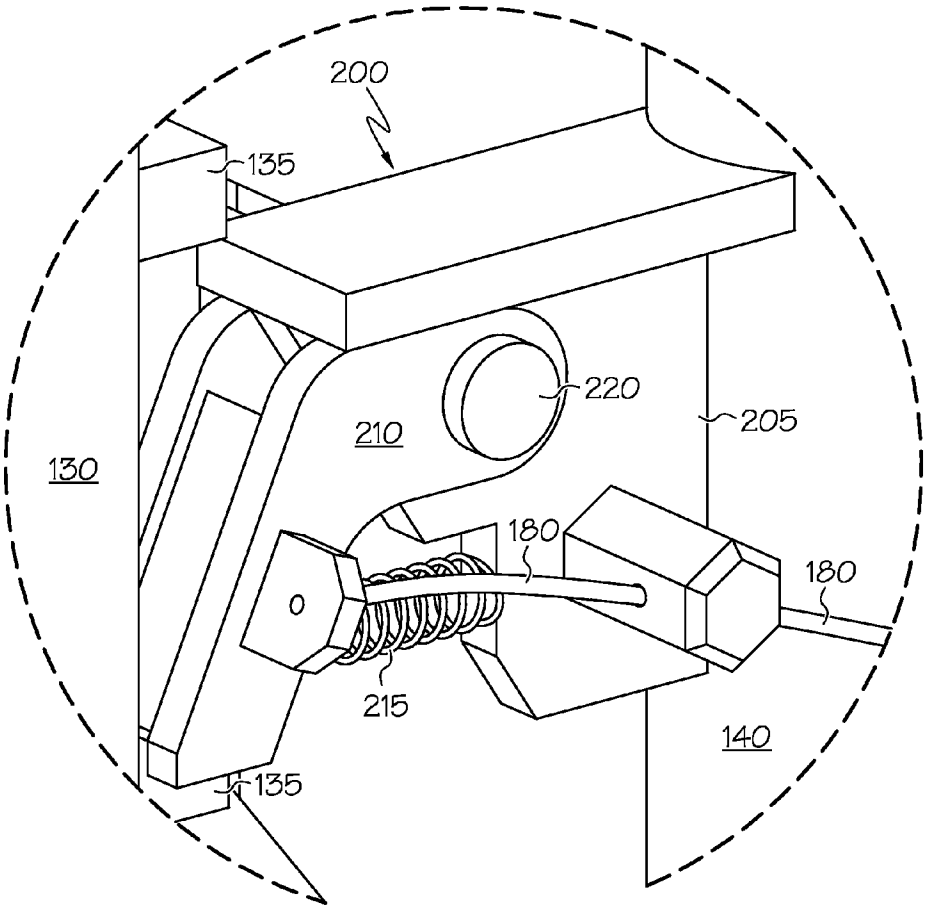
FIG. 3 is a diagram illustrating a latch assembly employed in the slidable weight bar assembly according to one embodiment.

FIG. 3 is a diagram illustrating a latch assembly employed in the slidable weight bar assembly according to one embodiment. The latch assembly 200 includes an attachment member 205, a latch member 210, and a spring 215. The latch member 210 is pivotally coupled to the attachment member by a pin 220. The spring 215 is fixedly coupled between the attachment member 205 and the latch member 210. The attachment member 205 of the latch assembly 200 is fixedly attached to an exterior of a sliding guide 140 such that it faces the protruding portions 135 of an opposing frame member 130 of the support frame 110. Further, as shown, the latch member 210 is also fixedly coupled to a distal end of the transmission cable 180.

In operation, when the levers 175 of the hand brake assemblies are in a depressed state (e.g., when the levers are squeezed by the operator of the apparatus), the respective transmission cables 180 are pulled back towards the hand brake assemblies 170. This mechanical signal causes the compression of respective springs 215, resulting in the respective latch members 210 to pivot about the pin 220 into a first position that disengages the slidable weight bar assembly 125 from a horizontal pair of the latch catches 135 of the support frame 130. In this first position, the respective latch members 210 are not in contact with any latch catch, enabling an operator to perform, for example, a squat exercise with guided movement of the slidable weight bar assembly 125 in the upward and downward direction along the slide poles 120.

In contrast, when the levers 175 of the hand brake assemblies 170 are in a released state (e.g., when the operator stops squeezing the levers), tension applied by the hand brake assemblies on the respective transmission cables 180, and thus the tension applied by the respective transmission cables 180 on the respective springs 215, are released. This mechanical signal causes the decompression of the respective springs 215, resulting in the respective latch members 210 to pivot about the pin 220 into a second position that engages the slidable weight bar assembly into one of the horizontal pairs of latch catches 135. In this second position, the respective latch members 210 are in contact with a horizontal pair of latch catches 135, preventing guided movement of the slidable weight bar assembly.

In a particular embodiment, the pivoting of the latch assemblies 200 into the second position during the released state allows the operator to block downward movement of the slidable weight bar assembly 125, but does not prevent upward movement. For example, referring to FIG. 3, as the slidable weight bar assembly moves in an upwardly direction in the released state, the latch member 210 brushes against a protruding catch 135 and pivots back against the spring 215 toward the attachment member 205. As the latch member 210 continues upwardly past the protruding catch 135, the latch member 210 pivots back to the second position by virtue of decompression of the spring 215 as shown in FIG. 3. This movement of the respective latch assemblies repeats in the released state as long as the upward movement of slidable weight bar assembly continues. However, once the weight bar assembly starts to move downwardly, further downward movement of the weight bar assembly is blocked at the position defined by a next pair of horizontal latch catches 135 of the support frame that engages the latch assemblies 200.

An advantage of this particular embodiment is that it enables an operator to perform explosive force jump or throw exercises. In such exercises, the operator positions himself/herself with their neck and shoulders against the arm handles of the slideable weight bar assembly. If the weight bar assembly is not a desired height, it can be changed by the operator squeezing the levers of the hand brakes assemblies, enabling free movement of the slidable weight bar assembly along the slide poles. Once the user positions the weight bar assembly at the desired height, the operator releases the levers, locking the weight bar assembly at a position defined by the latch assemblies engaging a horizontal pair of latch catches. Use of the brake levers is not required, if the desired height is above the present position of the weight bar assembly. In such instances, the operator can execute an upwards movement of the weight bar assembly without depressing the brake levers. Once the desired height is reached, a corresponding pair of horizontal latch catches will automatically block any downward phase of movement of the weight bar assembly as discussed above.

With the hand brake assemblies in the released state, the operator can jump or alternatively throw the weight bar assembly by a forceful upward movement of the arm handles. The guided movement of the slidable weight bar assembly continues in this upward direction until a maximum height is reached. Once the maximum height is reached, the weight bar assembly begins its downward descent until it is blocked at a position defined by a next pair of horizontal latch catches of the support frame that engages the latch assemblies. As a result, such exercises can be performed without the risk of damage to the operator's muscles or spine.

Figure 4:
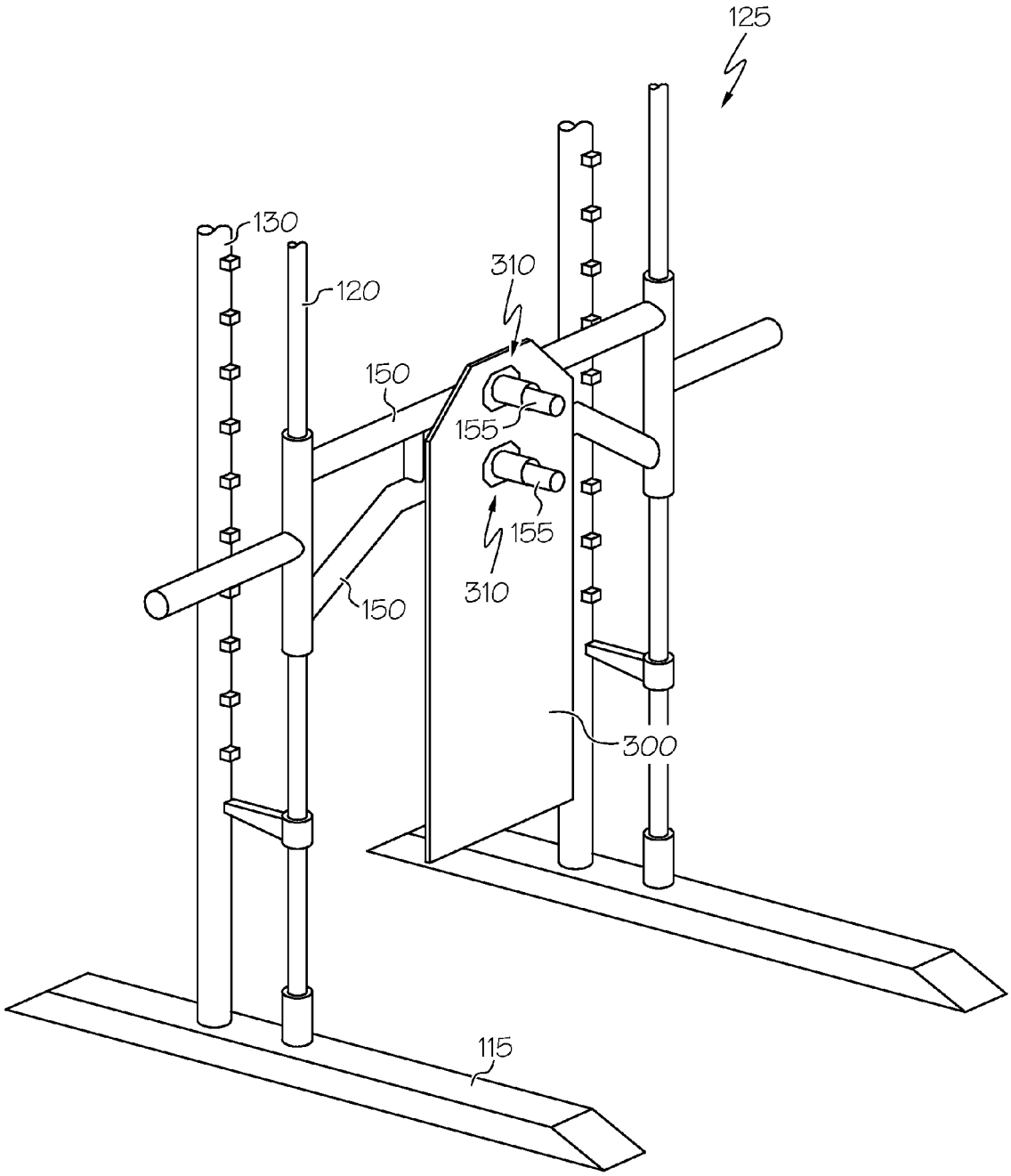
FIG. 4 is a diagram illustrating a back view of the slidable weight bar assembly according to one embodiment.

FIG. 4 is a diagram illustrating a back view of the slidable weight bar assembly according to one embodiment. As shown, a back support 300 is adjustably coupled to the slidable weight bar assembly 125. The back support 300 facilitates proper positioning and support of the operator's upper and lower back while performing a squat exercise. The back support 300 can be coupled to one or more of the coupling bars 150. For example, as shown, the coupling bars 150 include back support attachment members 155 that extend perpendicular from the planar configuration of the coupling bars 150. The back support 300 is configured with receptors 310 that define openings in the back support through which the back support attachment members 155 are received and locked in an adjustable position. For example, the back support receptors 310 can be provided with a series of locking holes through which a spring loaded pin (not shown) of the back support attachment members 155 can be positioned to lock the back support in a desired position. The desired position depends on the personal dimensions of the operator using the exercise apparatus. Other locking techniques known to those skilled in the art, including latches with screws, can be used for attaching the back support receptors 310 to the back support attachment members 155.

In another embodiment, the exercise apparatus can be configured for use as a bench press by removing the back support entirely from the exercise apparatus and placing a padded bench below the slideable weight bar assembly. Control of the weight bar assembly 125 can be performed in a similar manner as described above.

Figure 5:
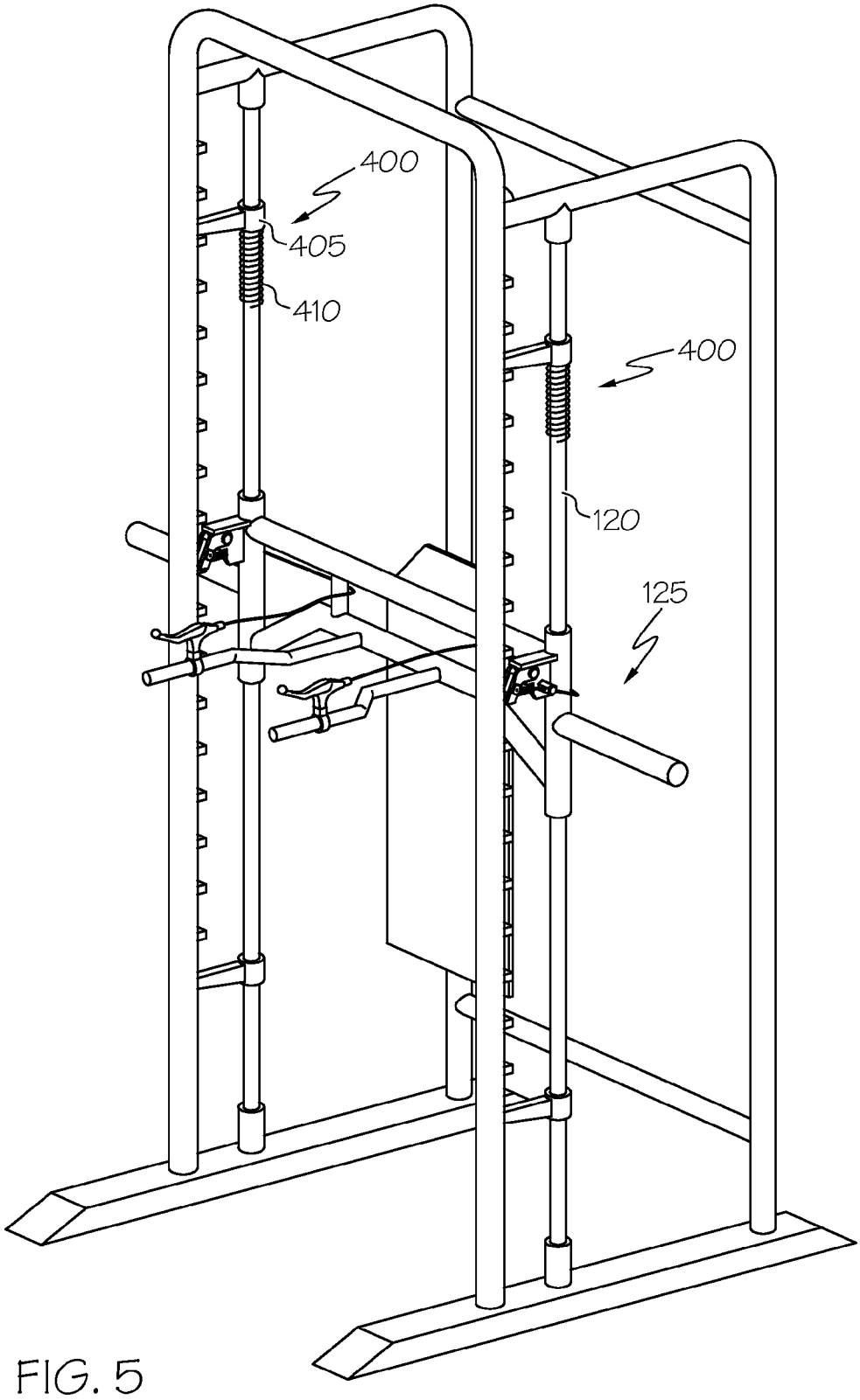
FIG. 5 is a diagram illustrating an exercise apparatus comprising a slidable weight bar assembly with hand brake assemblies according to second embodiment, which includes springs assemblies, each spring assembly being positioned on one of the vertical slide poles at a height above the slidable weight bar assembly.

FIG. 5 is a diagram illustrating an exercise apparatus comprising a slidable weight bar assembly with hand brake assemblies according to a second embodiment. In this embodiment, the exercise apparatus is identical to that described above and further includes spring assemblies 400 positioned about each of the vertical sliding poles 120 and above the slidable weight bar assembly 125. Each of these spring assemblies 400 includes a hollow base member 405 fixedly coupled to a spring 410. As shown, the combination of the hollow base member 405 and spring 410 receives a respective slide pole 120 and the base member 405 is adjustably attached to the slide pole at a desired height. The desired height depends on the operator of the exercise apparatus.

Preferably, the base is attached at a height that facilitates compression of the spring 410 against the base member 410 (i.e., spring loading) as the spring 410 comes in contact with the hollow sliding guides 140 during an upward movement of the slidable weight bar assembly 125 (i.e., positive or concentric work of muscle). Conversely, during downward movement of the slidable weight bar assembly (i.e., negative or eccentric work), the spring 410 will release the loaded energy as it decompresses, resulting in an increase in velocity of the descending weight bar assembly 125. This additional downward force on the weight bar assembly results in the operator having to handle a heavier kinetic load during the following phase of the inversion of the movement (i.e., downward movement of the weight bar assembly 125). Advantages of this embodiment can include improve the development of fast twitch muscular fibers.

While this invention has been particularly shown and described with references to preferred embodiments thereof, it will be understood by those skilled in the art that various changes in form and details may be made therein without departing from the scope of the invention encompassed by the appended claims.

What is claimed is:

1. An exercise apparatus, comprising:

a support frame comprising vertical sliding poles and plural sets of latch catches;

a slidable weight bar assembly coupled to vertical sliding poles of the support frame, the slidable weight bar assembly capable of guided movement along the sliding poles, the weight bar assembly comprising:

hollow sliding guides coupling the slidable weight bar assembly to the vertical sliding poles;

horizontal weight bars extending horizontally from the hollow sliding guides;

a set of latch assemblies coupled to an exterior of the sliding guides, the set of latch assemblies capable of pivotal movement for engagement with the plural sets of latch caches of the support frame;

arm handles extending from the weight bar assembly to form a yoke about a neck and shoulder area, a pair of hand brake assemblies, each hand brake assembly directly coupled to a terminal end of a respective arm handle, each hand brake assembly further coupled to a respective latch assembly of the set of latch assemblies by a transmission cable, the hand brake assemblies being operable to pivot the set of latch assemblies into a first position for disengaging the slidable weight bar assembly from one of the plural sets of latch catches of the support frame and into a second position for engaging the slidable weight bar assembly into one of the plural sets of latch catches of the support frame.

2. The exercise apparatus of claim 1, wherein each of the hand brake assemblies comprises a lever, when the levers are in a depressed state, the respective transmission cables each transmits a first mechanical signal causing the set of latch assemblies to pivot into the first position for disengaging the slidable weight bar assembly from one of the plural sets of latch catches, enabling guided movement of the slidable weight bar assembly along the sliding poles.

3. The exercise apparatus of claim 2, wherein when the levers are in a released state, the respective transmission cables each transmits a second mechanical signal causing the set of latch assemblies to pivot into the second position for engaging the sliding weight bar assembly into one of the plural sets of latch catches, preventing guided movement of the sliding weight bar assembly.

4. The exercise apparatus of claim 3, wherein guided movement of the sliding weight bar assembly is prevented in a downward direction only.

5. The exercise apparatus of claim 1, wherein each latch assembly further comprises a spring that compresses or decompresses to pivot a latch member when receiving the first mechanical signal or the second mechanical signal, respectively, from the transmission cable.

6. The exercise apparatus of claim 1, wherein the weight bar assembly further comprises a back support adjustably coupled to the slidable weight bar assembly.

7. The exercise apparatus of claim 1, further comprising springs, each spring positioned about one of the vertical sliding poles at a height above the slidable weight bar assembly, the springs being compressed by the hollow sliding guides during an upward movement of the weight bar assembly and the springs being released and generating an additional downward force on the weight bar assembly during a downward movement of the weight bar assembly.

8. The exercise apparatus of claim 1 is configured as a squat machine.

9. The exercise apparatus of claim 1 is configured as a bench press.

10. An exercise apparatus, comprising:

a support frame comprising vertical sliding poles and plural sets of latch catches;

a slidable weight bar assembly coupled to vertical sliding poles of the support frame, the slidable weight bar assembly capable of guided movement along the sliding poles, the weight bar assembly comprising:

hollow sliding guides coupling the slidable weight bar assembly to the vertical sliding poles;

horizontal weight bars extending horizontally from the hollow sliding guides;

a set of latch assemblies coupled to an exterior of the sliding guides, the set of latch assemblies capable of pivotal movement for engagement with the plural sets of latch caches of the support frame;

arm handles extending from the weight bar assembly to form a yoke about a neck and shoulder area, a pair of hand brake assemblies, each hand brake assembly directly coupled to a terminal end of a respective arm handle, each hand brake assembly coupled to a respective latch assembly of the set of latch assemblies, the hand brake assemblies being operable to pivot the set of latch assemblies into a first position for disengaging the slidable weight bar assembly from one of the plural sets of latch catches of the support frame and into a second position for engaging the slidable weight bar assembly into one of the plural sets of latch catches of the support frame.

* * * * *